US011479992B2

(12) United States Patent
Polega

(10) Patent No.: US 11,479,992 B2
(45) Date of Patent: Oct. 25, 2022

(54) DRAWER LATCH ASSEMBLY WITH LOCK FEATURE AND IMPROVED INSTALLATION

(71) Applicant: Greenheck Racing, Inc., Weston, WI (US)

(72) Inventor: Todd Polega, Hatley, WI (US)

(73) Assignee: Greenheck Racing, Inc., Weston, WI (US)

( * ) Notice: Subject to any disclaimer, the term of this patent is extended or adjusted under 35 U.S.C. 154(b) by 471 days.

(21) Appl. No.: 16/597,544

(22) Filed: Oct. 9, 2019

(65) Prior Publication Data

US 2020/0408003 A1 Dec. 31, 2020

Related U.S. Application Data

(60) Provisional application No. 62/866,441, filed on Jun. 25, 2019.

(51) Int. Cl.
*E05B 65/46* (2017.01)
*E05C 19/06* (2006.01)
*A47B 88/40* (2017.01)

(52) U.S. Cl.
CPC ..... *E05B 65/46* (2013.01); *E05C 19/063* (2013.01); *A47B 88/40* (2017.01)

(58) Field of Classification Search
CPC ..... E05B 65/00; E05B 65/46; E05B 65/461–467; E05C 19/00; E05C 19/06; E05C 19/063; A47B 88/00; A47B 88/40; A47B 88/50
USPC ..... 292/96
See application file for complete search history.

(56) References Cited

U.S. PATENT DOCUMENTS 1,241,192 A * 9/1917 Bruder ..... G06F 1/1656 292/124
3,117,731 A * 1/1964 Rackley ..... F21V 17/166 292/126
3,239,298 A * 3/1966 McCarthy ..... E05B 65/46 40/325
3,252,746 A * 5/1966 Kafferlin ..... E05B 65/46 312/234.3
4,006,951 A * 2/1977 Geer ..... E05B 65/46 312/333
4,018,148 A * 4/1977 Wolbrink ..... B30B 9/3032 100/229 A
4,023,875 A * 5/1977 Difley ..... B30B 9/3003 312/319.1

(Continued)

*Primary Examiner* — Nathan Cumar
(74) *Attorney, Agent, or Firm* — Quarles & Brady LLP

(57) ABSTRACT

A latching mechanism can secure one or more moveable members in a cabinet. The latching mechanism includes a support having a back plate mounted to the moveable member and having an opening extending therethrough, an end cap attached to the support and having a mating stem that extends into the support, and a latch having a leading end that extends through the opening in the back plate and a trailing end having a mating bore that is sized to receive the mating stem of the end cap. The mating bore of the latch defines a pivotal axis. The latch is configured to pivot along the pivotal axis between an open position in which the moveable member is moveable in the cabinet and a closed position in which the latch prevents the moveable member from moving away from the cabinet. A locking mechanism for this type of cabinet is also provided.

20 Claims, 8 Drawing Sheets

(56) References Cited

U.S. PATENT DOCUMENTS

| | | | | | |
|---|---|---|---|---|---|
| 4,068,872 | A * | 1/1978 | Smith | E05C 19/06 | 292/87 |
| 4,239,309 | A * | 12/1980 | De Fouw | E05B 65/463 | 312/219 |
| 4,947,661 | A * | 8/1990 | Yoshida | B60R 11/0205 | 292/226 |
| 5,292,191 | A * | 3/1994 | Slivon | E05B 65/46 | 292/128 |
| 5,445,451 | A * | 8/1995 | Harmony | A47B 88/57 | 312/333 |
| 5,868,478 | A * | 2/1999 | Yemini | A47B 95/02 | 312/333 |
| 6,547,289 | B1 * | 4/2003 | Greenheck | E05B 65/46 | 292/200 |

* cited by examiner

DRAWER LATCH ASSEMBLY WITH LOCK FEATURE AND IMPROVED INSTALLATION

CROSS-REFERENCE TO RELATED APPLICATIONS

This application claims the benefit of the filing date of U.S. Provisional Application No. 62/866,441 filed on Jun. 25, 2019, which is hereby incorporated by reference for all purposes as if set forth in its entirety herein.

BACKGROUND

Drawers, such as those used in tool chests, are well known to have latching mechanisms to secure the drawers shut. Such latching mechanisms can be used to establish a closed position of the drawer, prevent unexpected opening in the event the chest is moved or slightly tipped, and—if a lock mechanism is incorporated—to protect against theft of items stored in the drawer.

One such latching mechanism for drawers is found and described in U.S. Pat. No. 6,547,289 which was issued on Apr. 15, 2003 and which is incorporated by reference for all purposes as if set forth in its entirety herein. The latching mechanism disclosed in that patent includes a handle that, when pulled, releases one or more spring-loaded latches that are otherwise biased into a closed position for engagement with drawer mounting walls when the drawer is shut. When in the closed position and with the handle not yet pulled, the spring-loaded latches can be secured to the drawer mounting walls so as to prevent the drawer from being pulled opened without the user first pulling the handle relative to the drawer front and so as to prevent the drawer from sliding open if the cabinet receiving the drawer is independently moved or tilted. Then, when the handle is pulled, the handle effectuates the rotation of the spring-loaded latches against the biasing force to release and disengage the latches from the drawer mounting walls of the cabinet so that the drawer may be freely pulled open.

This latching mechanism has been quite popular commercially as it enables one handed opening of drawers with a single pulling motion, which is not permitted by many other latching mechanisms which can require two-handed operation or sequenced user actions such as first twisting and then pulling. Further, it provides the feel of a robust and high quality construction to the end user as the handle is also responsive to the biasing force of the latch.

SUMMARY

While the aforementioned latching mechanism represents a unique and improved latching mechanism over the state of the art at the time, there has remained some need for improvements to that basic design. For example, the disclosed implementation of spring-loaded latches involving compression springs between the latch and a support meant that assembly of this design was very time and labor intensive and could not be readily automated. Further yet, while the spring-loaded latches could "lock" the drawer, such "locking" was synonymous with the drawer being merely closed and could be overcome by simply pulling the handle. There was not a security lock-style mechanism that prevented entry to the drawer based on unique keyed or other authenticated access.

Disclosed herein are various improvements to this type of latching mechanism that incorporate aspects of this type of latching mechanism while also employing novel constructions offering further advantages and benefits to this style of latching mechanism. Some of these improvements provide new structure for providing biased latches while improving the ease of assembly and reducing manufacturing cost. Others provide an integrated locking mechanism that can coact with the biasing latches (either of known or of the newly disclosed novel construction) to provide a security lock on one drawer or a group of drawers so as to prevent the drawer(s) from being opened by a pulling of the handle alone.

According to some aspects, a latching mechanism is provided for latching closed a moveable member of a cabinet. The latching mechanism includes a support having a back plate mounted to the moveable member, such as a drawer. The back plate includes an opening extending therethrough. The latching mechanism further includes an end cap attached to a lateral end of the support and having a mating stem that extends at least partially into the support. The latching mechanism also includes a latch having a leading end that extends through the opening in the back plate and a trailing end having a mating bore that is sized to receive the mating stem of the end cap. The mating bore of the latch defines a pivotal axis for pivoting and rotation, where the latch is configured to pivot along the pivotal axis between an open position in which the moveable member is moveable in the cabinet and a closed position in which the latch prevents the moveable member from moving away from the cabinet.

According to another aspect, a locking mechanism is provided for locking a cabinet. The locking mechanism includes a movable member, a support, a pivoting member, a latch, and a locking member. The moveable member has a slideable connection to an interior surface within a mounting frame. The support provides a pivotal connection and has a back plate mounted to the moveable member in which the back plate has an opening extending therethrough. The pivoting member is attached to the pivotal connection for pivotal motion with respect to the pivoting member. The latch has a leading end that extends through the opening in the back plate and a trailing end attached to the pivotal connection. The leading end of the latch has a catch surface and a locking stop surface. The latch is operated by the pivoting member to pivot along a pivotal axis between an open position in which the moveable member is moveable within the cabinet and a closed position in which in which the catch surface engages the mounting frame to inhibit motion of the movable member. The locking member is attached to the mounting frame and is translatable between a locked position in which the locking member engages the locking stop surface of the latch to inhibit movement of the latch from the closed position to the open position and an unlocked position in which the latch is free to pivot along the pivotal axis from the closed position to the open position.

These and other advantages and features of the invention will become more apparent from the following detailed description of the preferred embodiments of the invention when viewed in conjunction with the accompanying drawings.

DETAILED DESCRIPTION

Figure 1:
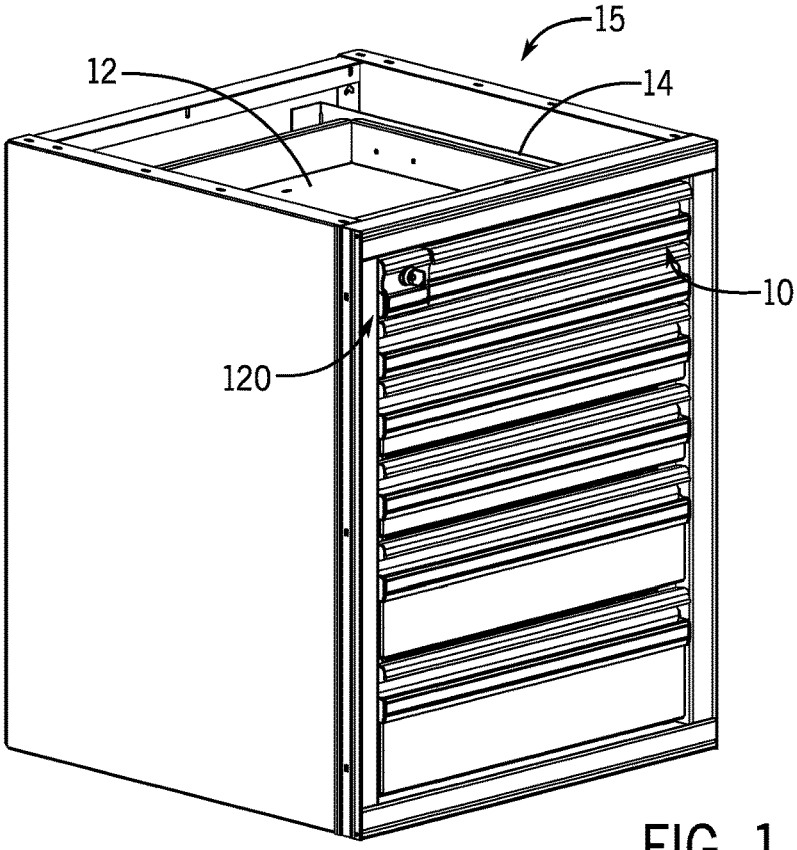
FIG. 1 is a front perspective view of a cabinet having a latching mechanism and a locking mechanism.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
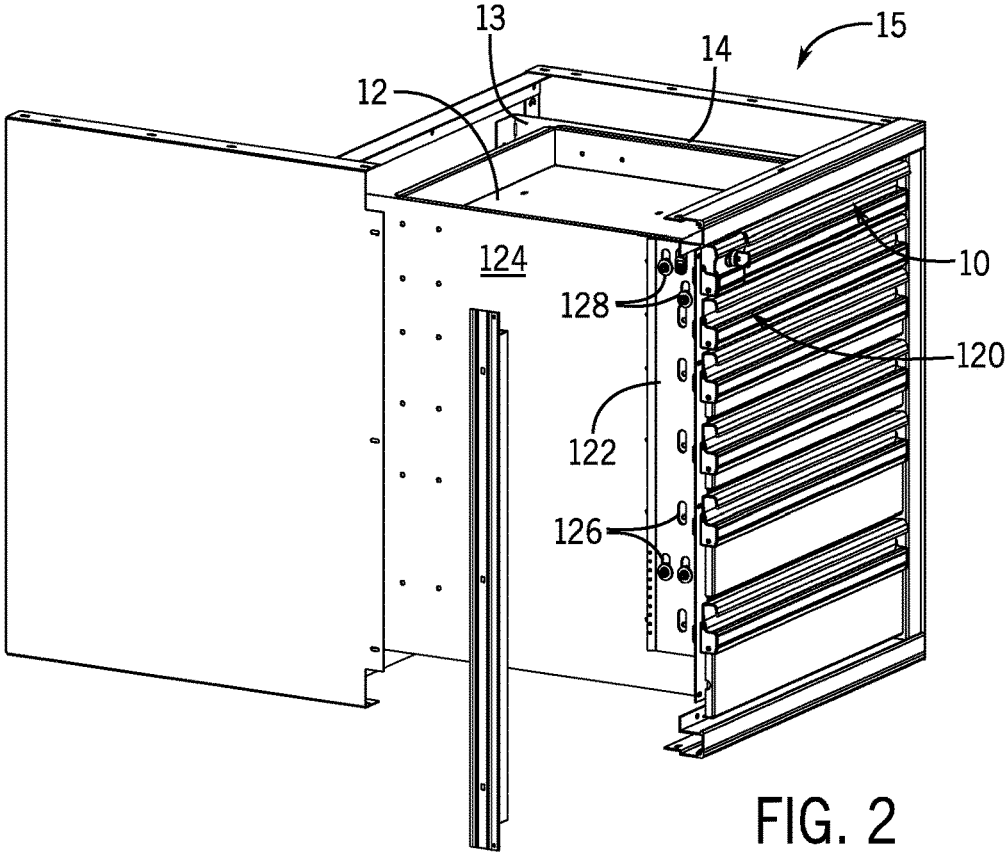
FIG. 2 is a front perspective view of a partially exploded cabinet from FIG. 1 to show the latching mechanisms and the locking mechanism therein.

FIGS. 1-13 depict a latching mechanism 10 and a locking mechanism 120 for securing a moveable member 12 (e.g., a drawer) within a cabinet 15 which is illustrated fully assembled in FIG. 1 and with a side panel removed therefrom in FIG. 2. It will be appreciated that such a cabinet 15 can include multiple drawers and such latching mechanisms as those that will be described below can be found as part of each drawer and each drawer may also have multiple latching mechanisms (e.g., one on each lateral side of the drawer). Of course, the described details regarding the latching mechanisms may also work in single drawer cabinets. In some embodiments, the moveable member 12 is slidably attached to an interior surface 13 of a mounting frame 14.

Referring now to FIGS. 3-8 and 10-11 more specifically, the latching mechanism 10 generally includes a support member 16 attached to a front face of the moveable member 12. The support member 16 may include a back plate 18 having an angled upper lip 19 forming an inverted channel 20 extending along a rear top edge 22 that can be attached to a front edge or face of the moveable member 12. It should be noted that the latching mechanism 10 of the present invention could be attached to the drawer with suitable adhesives or fasteners, such as threaded fasteners, instead of, or in addition to, the inverted channel 20.

In some embodiments, the support member 16 has a lower extremity defining a front wall or face portion 24 having an inwardly extending lip 26 at its top edge 28. The face portion 24 includes a lengthwise channel 30 along a middle portion and a pivotal connection 32. The pivotal connection 32 may form an arcuate pivot groove 33 along a bottom of the inside surface of the face portion 24. A latch 46 having a trailing end 48 defining an arcuate projection 50 may be sized to fit within the pivotal connection 32 of the support member 16 and more specifically in some forms, in the arcuate pivot groove 33. The support member 16 can also include two threaded grooves 34, suitably located along the support member 16, for receiving threaded fasteners for securing an end cap 35 at each end of the support member 16.

Figure 4:
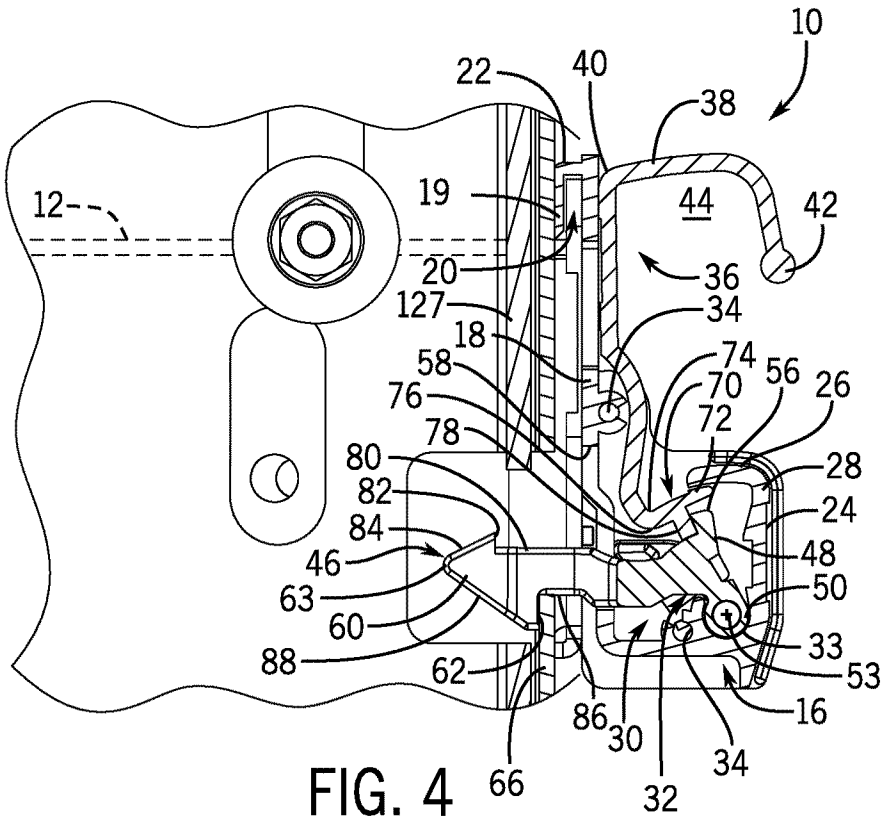
FIG. 4 is a cross-sectional side view of the detailed view from FIG. 3 showing the interior components of the latching mechanism in the closed position with the locking mechanism in the unlocked position.
Figure 3:
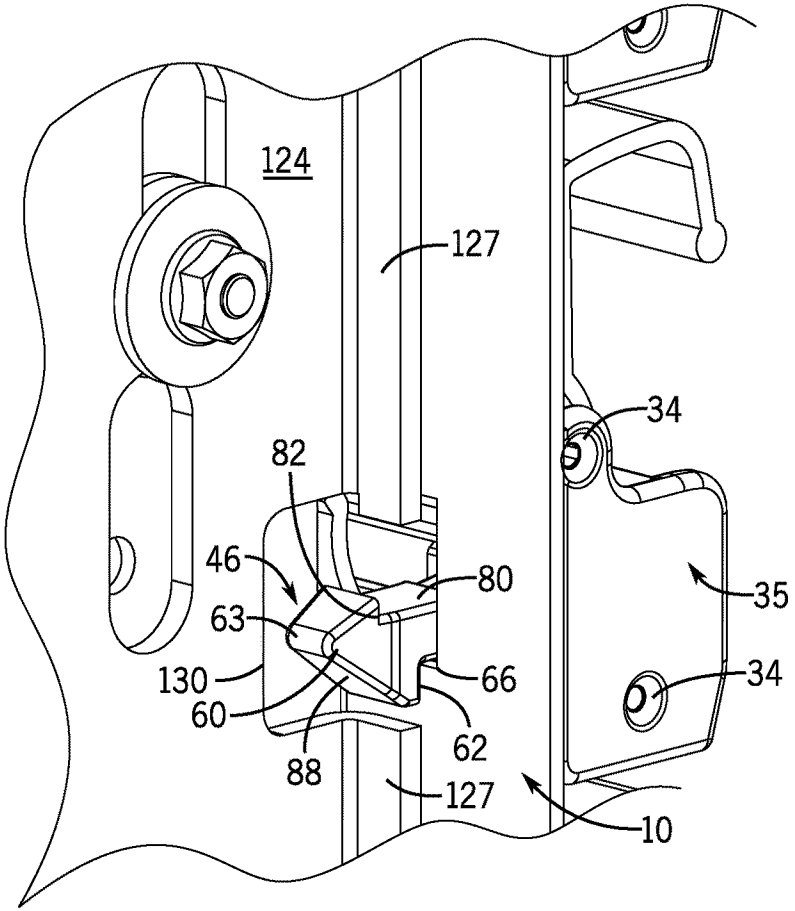
FIG. 3 is a detailed rear perspective view of one of the latching mechanisms in a closed position with the locking mechanism in an unlocked position.
Figure 6:
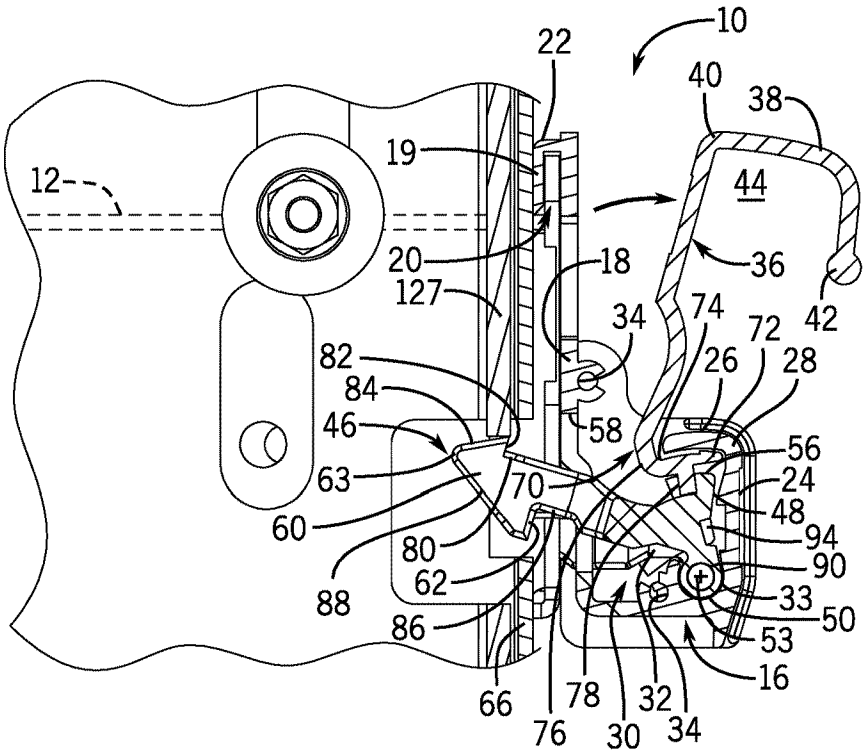
FIG. 6 is a cross-sectional side view of the detailed view from FIG. 5 showing the interior components of the latching mechanism in the open position with the locking mechanism in the unlocked position.
Figure 5:
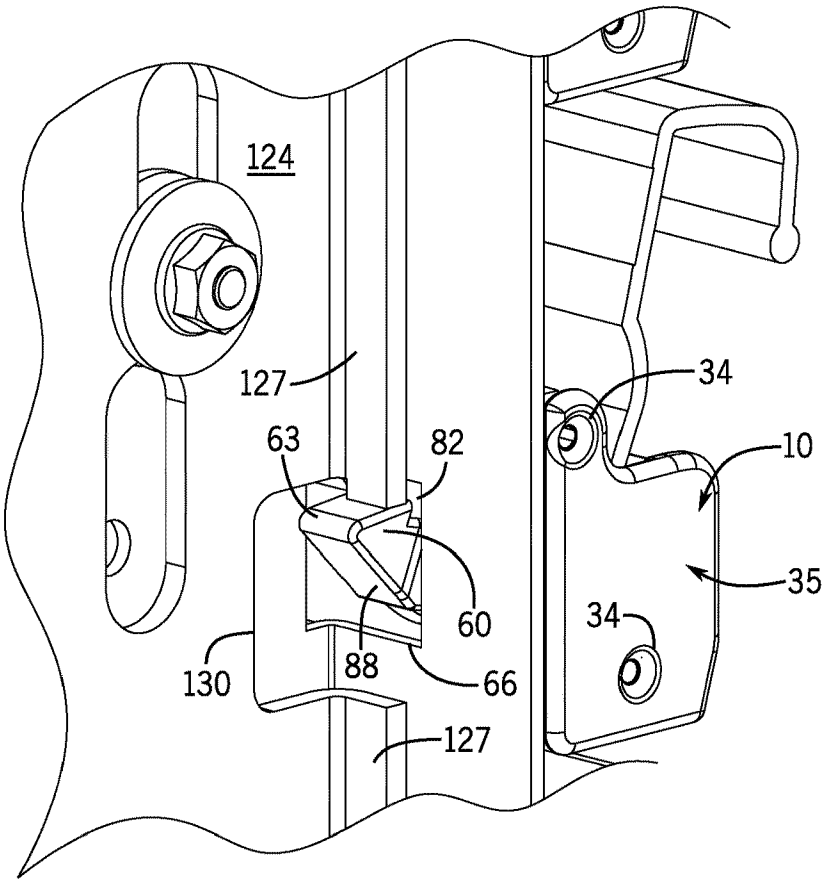
FIG. 5 is a detailed rear perspective view of the latching mechanism in an open position and the locking mechanism in the unlocked position.

The latch 46 may pivot along a pivotal axis 53 within the pivotal connection 32 as is most apparent when FIGS. 3-4 are compared to FIGS. 5-6, for example. Such pivoting of the latch 46 may be effectuated by a pivoting member 36 (e.g., a pull or a handle). The trailing end 48 of the latch 46 includes a ledge 56 that can be engaged by a pivoting member 36 and is configured to operate the latch 46 to move, rotate, or pivot the latch 46 between a closed position (e.g., a position where the latch engages the cabinet 15 or locking member 17) as illustrated in FIGS. 3-4 and an open position (e.g., a position in which the latch is free from the cabinet 15 or locking member 17) as illustrated in FIGS. 5-6.

The latch 46 extends inwardly from the trailing end 48 through an opening 58 in the back plate 18 of the support member 16 to a leading end 60. A top face 80 of the latch 46 defines a locking stop surface 82 and a tapered upper surface 84 extending to a leading edge 63 on the latch 46. A bottom face 86 of the latch 46 defines a catch surface 62 and a tapered bottom surface 88 extending to a leading end 60 on the latch 46.

As briefly noted above, the latching mechanism 10 includes a pivoting member 36. The pivoting member 36 may comprise an elongated handle made of aluminum or plastic. The pivoting member 36 includes a generally L-shaped grip 38 extending from a top end 40 of the pivoting member 36 outwardly from the moveable member 12 and downward. The grip 38 terminates in a lengthwise bead 42 and forms a hand grip for grasping the handle 36 when opening the drawer. The grip 38 and the lip 26 of the support member face portion 24 define a cavity 44 sized large enough to grasp the lip 38 while wearing hand coverings, such as gloves and mittens, for example. The lip 26 of the support member face portion 24 acts to retain the handle 36 within the support member 16 and restrict its rotation. The pivoting member 36 further includes a generally T-shaped engagement member 70 extending from a leading end 72 to a lower edge 74 of the handle. A bottom surface 76 of the engagement member 70 includes a projection 78 extending therefrom that is sized to engage the ledge 56 of the latch 46. As the pivoting member 36 pivots away from the moveable member 12, the engagement member 70 influences the latch 46 to pivot along the pivotal axis 53.

In particular, referring to FIGS. 3-6, as a user pulls the pivoting member 36 outwardly, the pivoting member 36 pivots away from the moveable member 12 along the pivotal connection 32. As the pivoting member 36 pivots, the engagement member 70 of the pivoting member 36 engages the ledge 56 of the latch 46, which pivots the latch 46 along the pivotal axis 53 towards from a closed position, as shown in FIGS. 3 and 4, to an open position, as shown in FIGS. 5 and 6. This action disengages the catch surface 62 of the leading end 60 from a fixed stop portion 66 of the mounting frame 14 freeing the moveable member 12 from the cabinet 15. Thus, using the latching mechanism 10, the moveable member 12 can be easily unlatched and opened with one hand by pulling outward on the handle in a single motion.

In some embodiments, the pivoting member 36 is independent of the latch 46. In some embodiments, the pivoting member 36 is adhered or otherwise directly attached to the latch 46, such that the pivoting member 36 and the latch 46 pivot together.

Figure 7:
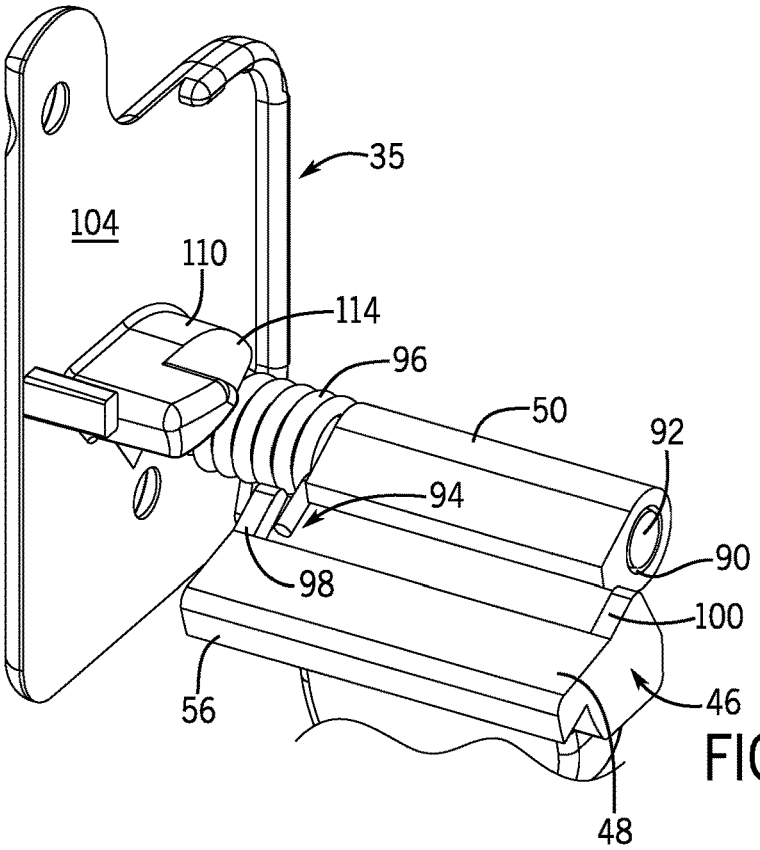
FIG. 7 is a perspective view of an end cap partially assembled with a latch and a torsion spring that will form part of one of the latching mechanism from the cabinet illustrated in FIG. 1.
Figure 8:
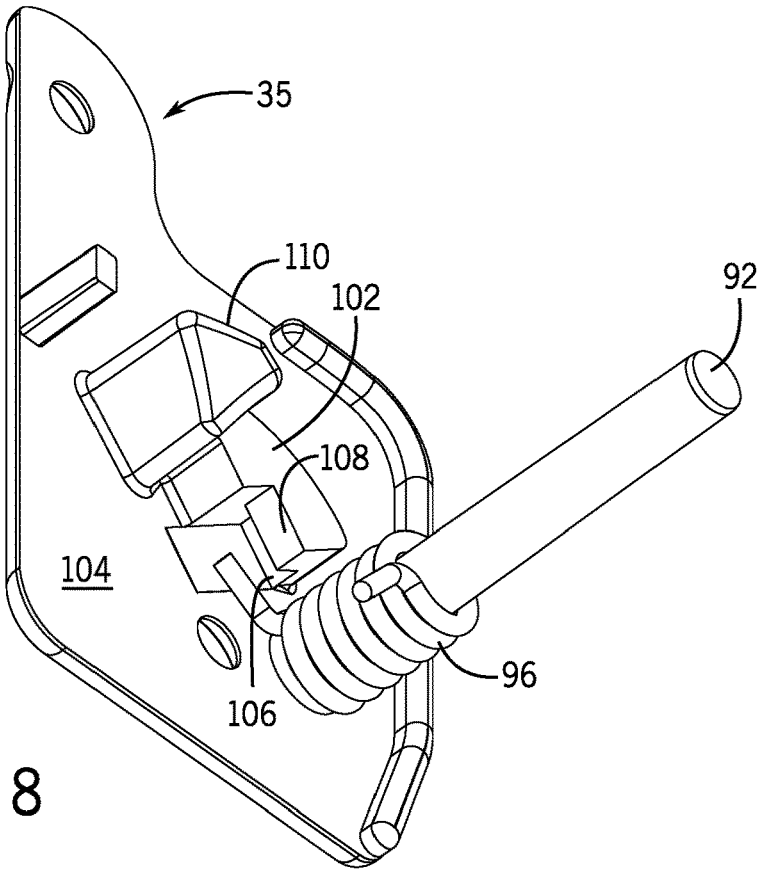
FIG. 8 is another perspective view of the end cap partially assembled with the torsion spring as in FIG. 7, but before the latch has been inserted, so as to illustrate the engagement of one end of the torsion spring with the end cap.

Referring now to FIGS. 7-8, the trailing end 35 of the latch 46 includes a mating bore 90 that is sized to receive a mating stem 92 of the end cap 35. A front face of the trailing end 48 also has a spring pocket 94 configured to receive a spring biasing member 96 such as a radially-extending leg of a torsion spring 96. The spring pocket 94 may define a recessed channel in the front face of the terminal end 48 that extends between a first lateral side wall 98 and a second lateral side wall 100. In some embodiments, a width defined by the first lateral side wall 98 and the second lateral side wall 100 is greater than a width defined by the arcuate projection 50 of the latch 46. In this regard, the terminal end of the torsion spring may be nested or otherwise supported between the first lateral side wall 98 and an outside edge of the arcuate projection 50, or the second lateral side wall 100 and an outside edge of the arcuate projection 50.

In some embodiments, the spring biasing member 96 is received around the mating stem 92 of the end cap 35. The end cap 35 may include a spring support member 102 that is configured to receive and support the spring biasing member 96. In some embodiments, the spring support member 102 projects from an inside surface 104 of the end cap 35 to define a spring pocket 106 that is sized to receive a terminal end of the torsion spring (e.g., a radially-extending end leg). In some embodiments, the terminal end of the spring biasing member 96 is nested or otherwise supported between the inside surface 104 of the end cap 35 and a supporting wall 108 of the spring support member 102. Although not shown in the figures, it is also contemplated that the terminal end of the torsion spring could be nested into a recessed region within a side wall of the end cap.

Figure 9:
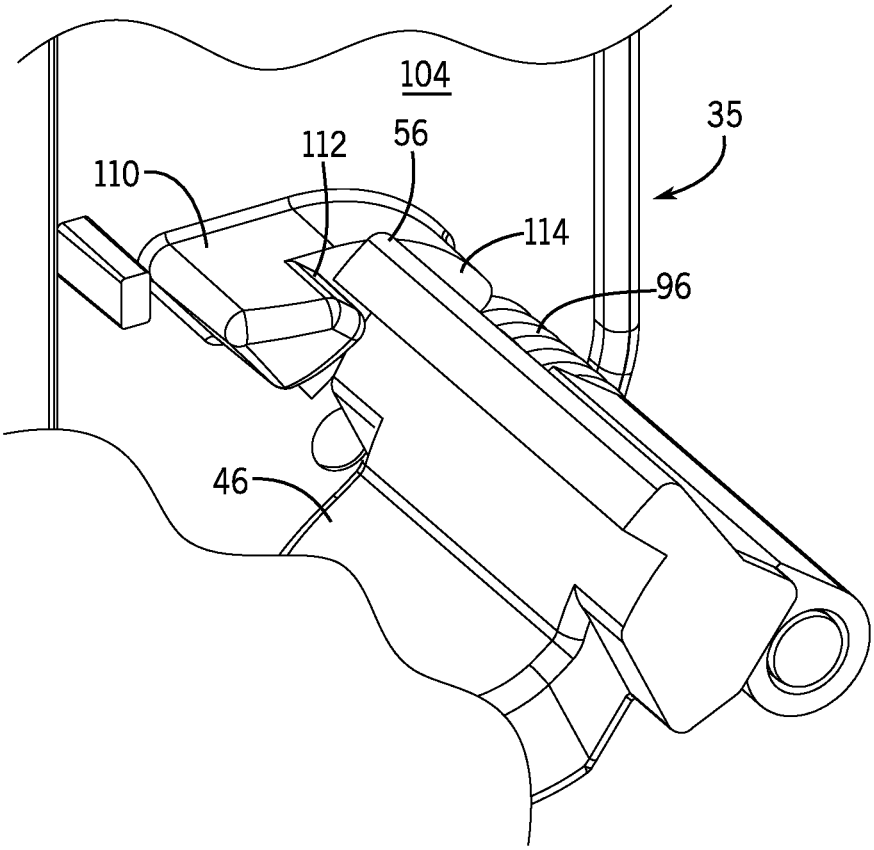
FIG. 9 is another perspective view of the end cap partially assembled with the spring and the latch in which the latch positioned so as to load the torsion spring and has been positioned relative to the end cap.

Referring to FIGS. 7 and 9, the end cap 35 further includes a shelf member 110 configured to support the latch 46. The shelf member 110 may project from an inside surface 104 of the end cap 35 to define a seat portion 112. The spring biasing member 96 may force or bias the ledge 56 of the latch 46 to engage the seat portion 112 of the shelf member 110 while in the closed position and provide an angular stop. The seat portion 112 may generally form an L-shape having an inside wall 114 spaced from the inside surface 104 of the end cap 35 and the seat portion 112 that projects inwardly and is configured to receive the ledge 56 of the latch 46. As the latch 46 pivots between the open and closed position, an outside surface of the ledge 56 may slide along or next to the inside wall 114 of the shelf member 110.

In some embodiments, utilizing the spring biasing member 96, spring support member 102, and/or the shelf member 110 of the present disclosure offers improvements during the assembly and manufacture of the latching mechanism 10. In particular, these elements simplify assembly of the latching mechanism 10, thereby reducing assembly time and overall manufacturing cost. For example, during assembly and working from the illustrated configuration of FIG. 7, with the radially-extending legs of the torsion spring of the spring biasing member 96 being in pockets 94 and 106, the spring biasing member 96 can be easily loaded prior to installation in the support member 16. Working from the position illustrated in FIG. 7, the latch 46 can be rotated to load the spring biasing member 96 so as to create a biasing force. This rotation can be effectuated simultaneously with an axial extension of the spring biasing member 96 is to axially stretch the spring biasing member 96 so that the ledge 56 of the latch 46 can be rotated past the shelf member 110. After the ledge 56 of the latch 46 has been rotated past the shelf member 110, the spring biasing member 96 is permitted to axially compress again, drawing the latch 46 and the end cap 35 closer together in the axial direction by virtue of the engagement of the legs of the torsion spring with the pockets 94 and 106, thereby drawing the ledge 56 in a position in which, the spring biasing member 96 is unable to fully unload the biasing force because the ledge 56 is now positioned to engage the shelf member 110 upon rotation of the latch 46 based on its axial positioning. In such a pre-loaded condition, the sub-assembly of the end cap 35, the spring biasing member 96, and the latch 46 can be axially inserted into the support member 16 together (perhaps with minimal further rotation of end cap 35 against the biasing force relative to the latch 46 to permit insertion) and then the end cap 35 may be screwed or otherwise secured to the end cap 35 to support member 16 (e.g., at threaded holes 34).

In use, the torsion spring or spring biasing member 96 then causes the latch 46 to rotate towards the closed position which also tends to cause the handle or pivoting member 36 to end to be moved the closed position unless it is pulled by the user to overcome the biasing force and rotate the latch.

Looking now at another aspect of the construction and referring to FIGS. 1-2 and 10-13, a locking mechanism 120 is illustrated. The locking mechanism 120 can be used for locking a moveable member 12 inside of a cabinet 15. In some embodiments, the locking mechanism 120 includes a locking member 122 in the form of a plate that is attached to an exterior surface 124 of the mounting frame 14 as best shown in FIG. 2. The locking member 122 is configured to translate (e.g., slide) between a locked position in which the moveable member 12 is secured within the cabinet 15, and an unlocked position in which the moveable member 12 is free to slide outside of the cabinet 15. In some embodiments, and as best seen in FIG. 2, the locking member 122 includes apertures or slots 126 configured to receive fasteners 128 to attach or otherwise secure the locking member 122 to the mounting frame 14 and delimit its path of motion. For example, the slots 126 may be sized such that the locking member 122 translates (e.g., slides) up and down between the locked and unlocked position without contacting the fastening 128 elements.

Figure 11:
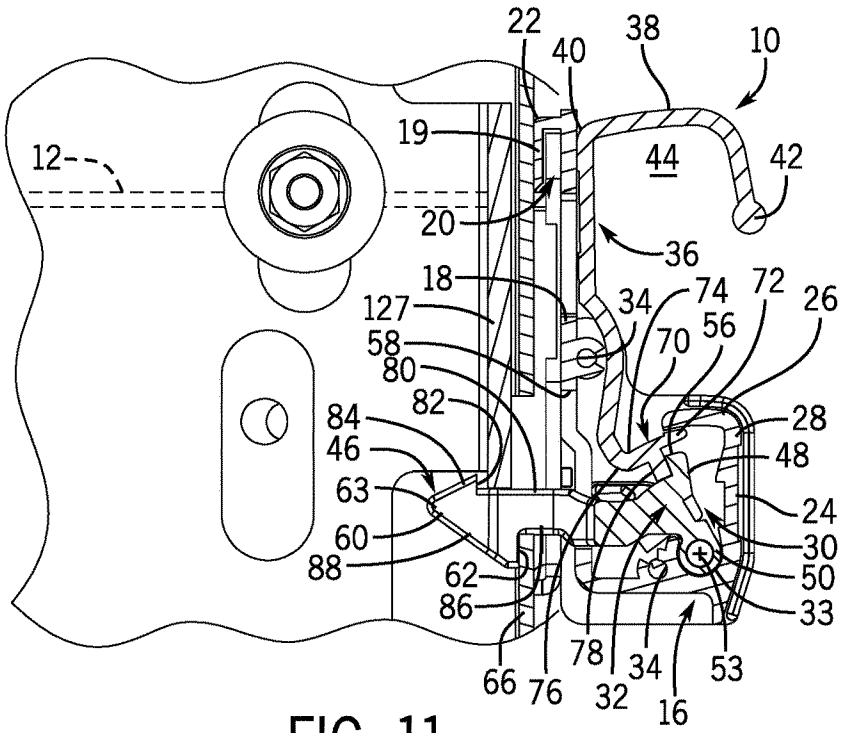
FIG. 11 is a cross-sectional view of the detailed view from FIG. 5 showing the interior components of the latching mechanism in the closed position with the locking mechanism in the locked position.
Figure 10:
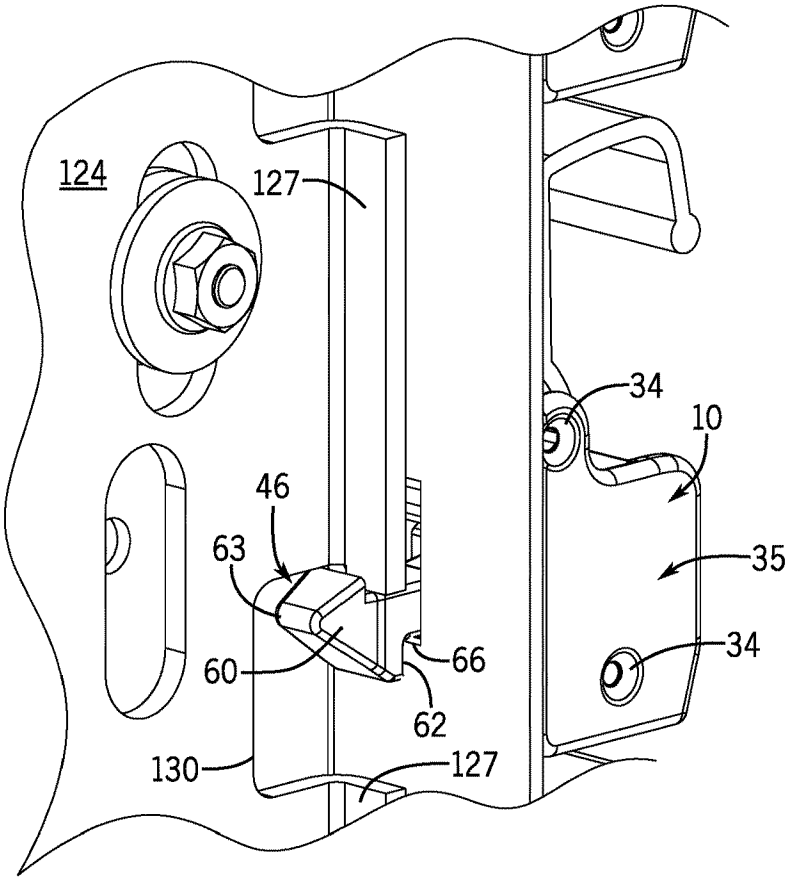
FIG. 10 is a detailed rear perspective view of the cabinet from FIG. 1 in which the latching mechanism is in a closed position and the locking mechanism is in the locked position.

In some embodiments, the locking member 122 can be a panel sheet as illustrated. The panel sheet may be substantially flat and configured parallel to the exterior surface 124 of the mounting frame 14. In such an arrangement or configuration, the locking member 122 might also include one or more locking tabs 127 projecting from a facial surface of the locking member 122 as is best illustrated in the detailed rear perspective views of FIGS. 3, 5, and 10. In some embodiments the locking tab 127 projects from an edge on the facial surface and general forms an L-shape. The locking member 122 further includes a recessed region or latch pocket 130 sized to receive the leading end 60 of the latch 46. The latch pocket 130 may be sized to allow the latch 46 to pivot between the open and closed position when the locking mechanism 120 is in the unlocked position which is shown in FIGS. 3-6 and 12. Referring to FIGS. 10, 11 and 13, when the locking member 122 is then moved to the locked position, the locking tab 127 engages the locking stop surface 82 of the latch 46 or the top face 80 of the latch, thereby preventing the latch 46 from being able to pivot.

Figure 12:
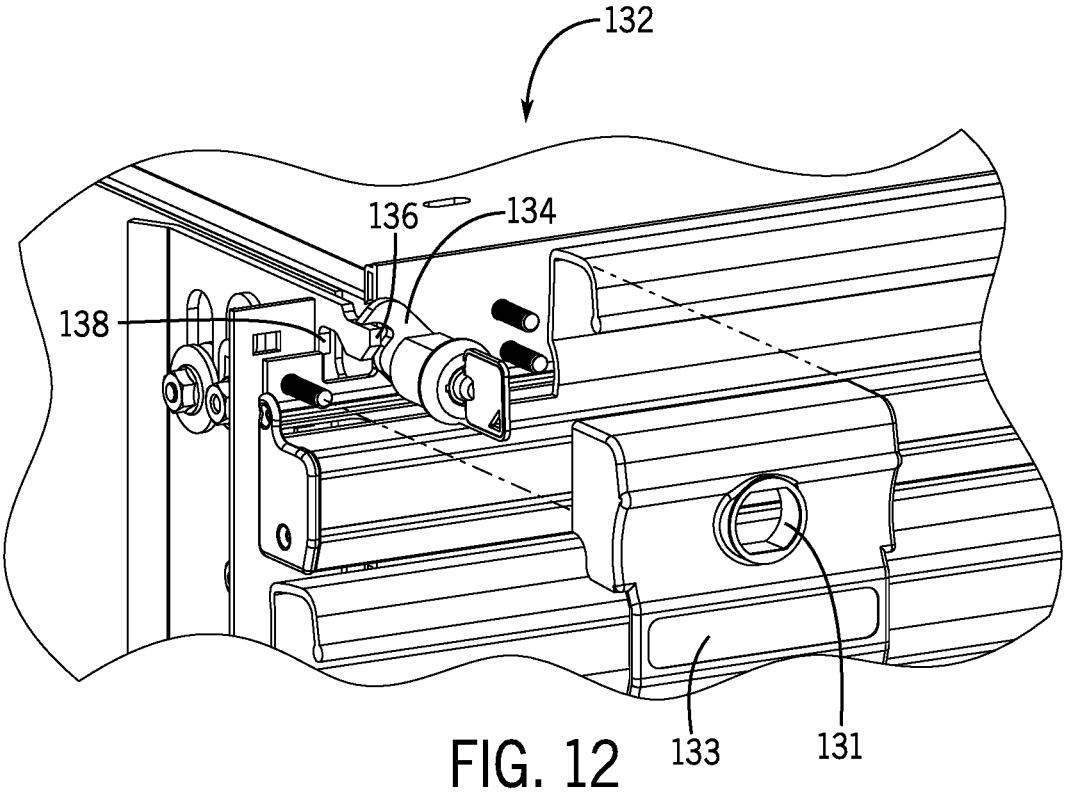
FIG. 12 is a front perspective view of a partially exploded locking mechanism from the cabinet of FIG. 1 in the unlocked position.
Figure 13:
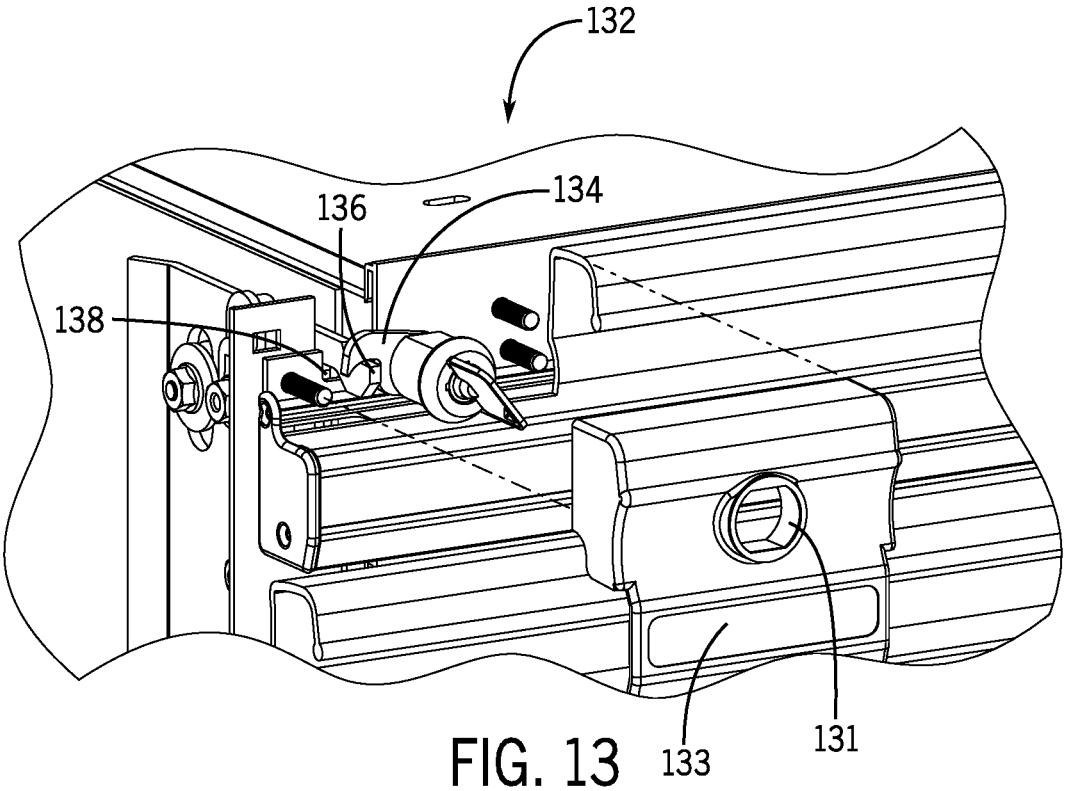
FIG. 13 is a front perspective view of the partially exploded locking mechanism similar to FIG. 12, except that the locking mechanism has been moved into the locked position.

Referring to FIGS. 12-13, the locking mechanism 120 may include a lock and key assembly 132 attached to a front face of the moveable member 12 so as to actuate the locking member 122. The lock and key assembly 132 includes a driving member 134 or arm configured to translate the locking member 122 between the unlocked position (e.g., FIGS. 3-6 and 12) and the locked position (e.g., FIGS. 10, 11, and 13) by displacing the locking member 122 over its delimited range of motion relative to the rest of the cabinet. In some embodiments, the driving member 134 is a lever arm that extends from the lock and key assembly 132 and is placed in contact with a forwardly protruding tab 136 of the locking member 122. The protruding tab 136 may extend from the panel sheet through an aperture 138 in the front face of mounting frame 14 to contact or otherwise engage the driving member 134. The lock and key assembly 132 may include a keyhole 131 configured to receive a key that operates the lever arm (e.g., rotates the lever arm) to contact the protruding tab 136 to translate the locking member 122 between the unlocked position and the locked position. As illustrated, the locking member 122 is biased upwardly (as will be described more below) into the unlocked position illustrated in FIG. 12 and the rotation of the key can cause the downward rotation of the driving member 134 to push the locking member 122 down against this lift assist or biasing force to the locked position of FIG. 13. In some embodiments, the locking mechanism 120 includes a cover 133 to enclose the lock and key assembly 132. The cover 133 may include an aperture 135 that is sized to allow a key to be placed in contact with the keyhole 131. As illustrated in FIGS. 12 and 13, the cover 133 is exploded from the rest of the assembly to better show the underlying lock and key parts and how they and how specifically the driving member 134 interact with the tab 136 of the locking member 122.

Figure 15:
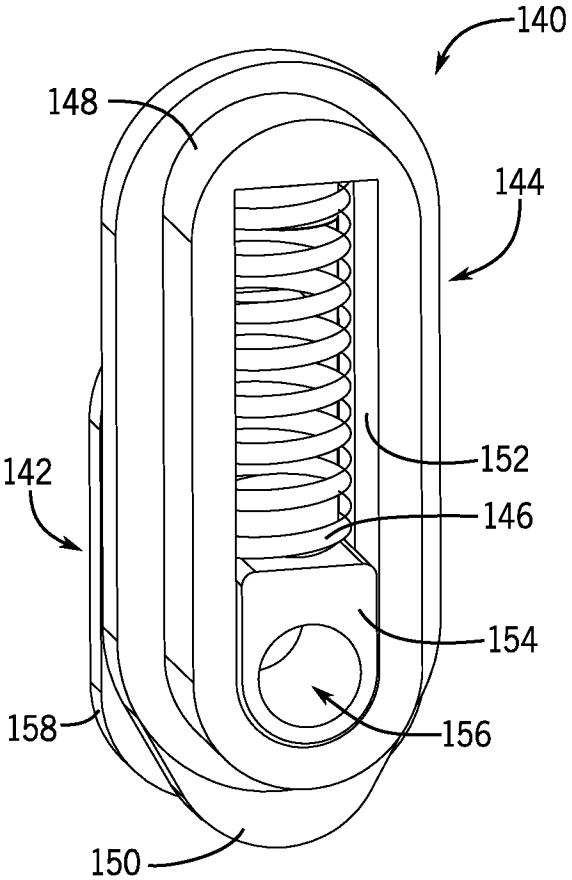
FIG. 15 is a rear perspective view of the unlock-assist assembly apart from the rest of the cabinet to better show its three constituent parts.
Figure 14:
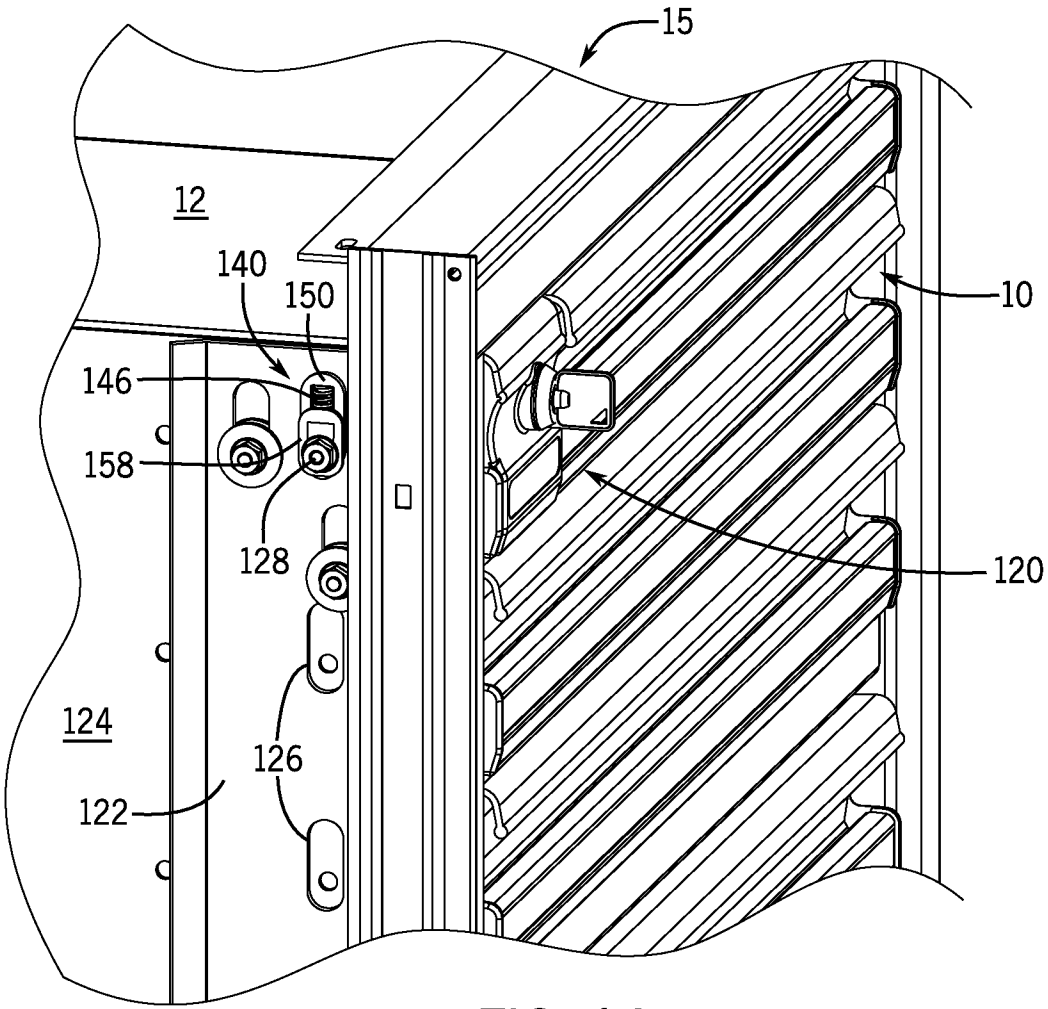
FIG. 14 is a front perspective view similar to FIG. 2, but in which an unlock-assist assembly has been further incorporated into the design.

Referring to FIGS. 14-15, it is contemplated that in some embodiments of the cabinet, the locking mechanism 120 may include one or more lift-assist assemblies 140 or biasing components that are configured to bias the locking mechanism 120 toward the unlocked position (e.g., FIGS. 3-6 and 12) and which must be overcome by downward force to place the locking mechanism in the locked position (e.g., FIGS. 10, 11, and 13). In general, each lift-assist assembly 140 includes a fixed member 142 coupled to the mounting frame 14 via a bolt or other fastener, a translatable member 144 coupled an aperture 128 in the locking member 122, and a biasing member 146 that is configured to bias the locking member 122 upwardly towards the unlocked position. As illustrated, this upward biasing force is sufficient to maintain the locking member 122 in the unlocked position by default and is only overcome when the driving member 134 is rotated with sufficient force to downward drive the locking member 122 to the locked position against the force of the lift-assist assemblies 140. While not illustrated in FIG. 14, it should be appreciated that some of the other slots 126 may have fasteners 128 received in them, similar to what is illustrated in FIG. 2, for example, to enable guidance of the locking member 122 relative to the mounting frame 14.

As best shown in FIG. 15, the translatable member 144 includes a back projection 148 that extends at least partially into the aperture 126 and a front collar 150 that extends outwardly from the back projection 148 to engage an external surface of the locking member 122 that can serve as an insertion stop. In some embodiments, an external periphery of the back projection 148 is received in an inner surface of the aperture 126 of the locking member 122 to position and/or secure the translatable member 144 to the locking member 122 (and which projection 148, in some instances, may be press fit into the aperture 126). The translatable member 144 also includes a vertically-extending slot 152 that extends centrally through the front collar 150 and the back projection 148 through which the fixed member 142 is received.

As illustrated, the fixed member 142 includes a mating projection or barrel 154 received within the slot 152 of the translatable member 144 and further has an opening 156 for reception of a fastener 128 that is coupled to the mounting frame 14. The fixed member 142 further includes a front flange 158 extending outwardly from the mating barrel 154. The front flange 158 may be configured to receive a head of the fastener 128 and the front flange 158 can sandwich the front collar 150 of the translatable member 144 between it and the locking member 122 to maintain the lift-assist assembly 140 together and the locking member 122 attached to the mounting frame 14. Once the lift-assist assembly 140 is assembled, the slot 152 may be sized such that the translatable member 144 and locking member 122 can translate (e.g., vertically slide) between the locked and unlocked position, while the fixed member 142 remains statically fixed to the mounting frame 14.

The biasing member 146 is configured to bias or provide an assistive force between the translatable member 144 and locking member 122 to bias and lift the locking member 122 towards the unlocked position. As illustrated, the biasing member 146 (here a spring) is positioned between the top side of the mating barrel 154 and a downward-facing side at the top of the slot 152 such that, with the fixed member 142 being fixed relative to the mounting frame 14, the biasing member 146 provides an upward lift force on the translatable member 144 which is, in turn, affixed to the locking member 122 to provide the amount of force required to lift the locking member 122 to the unlocked position. Because this upward lift assist force needs to be overcome when the driving member 134 is rotated by operation of the key to the locked position, it will be appreciated that the biasing member or spring selected may have compressive spring qualities that provide the desired amount of assistive lift but not too much so as to make it difficult to use the key to drive the driving member 134 to push the tab 136 and thus the locking member 122 downward (i.e., enough force to lift the locking member 122 to the unlocked position, but not so much force to prevent operation of the lock and key assembly 132 from being able to overcome this lift force when moving the locking member to the locked position)).

Further to issue of the selection of the appropriate lift force, it may be the case that one lift-assist assembly may not be sufficient to provide the desired amount of lift assistive force. So while a single lift-assist assembly 140 is illustrated in FIG. 14, it will be readily appreciated that, in some forms, multiple lift-assist assemblies 140 may be utilized with the locking mechanism 120 to ensure the biasing force required to move the locking member 122 to the unlocked position by default by additively combining multiple unlock-assist assemblies at different positions of the locking member 122 (but not including so many as to make it prohibitively difficult to overcome this force when the user operates the lock and key assembly 132 to lock it).

Still, further, it will be appreciated that while one specific form of a lift-assist assembly has been illustrated in FIGS. 14 and 15, that other unlock-assist assemblies designs and variations might be used instead to similar effect. For example, it is completed that instead of the above described three part assembly, that the translating member could be integral or part of the locking mechanism 122. Still further, it is contemplated that instead of the fixed member being a separate component, it could be formed as part of the mounting frame 14. Different biasing members or arrangements are likewise contemplated, all of which might provide the aforementioned upward lifting force.

Still further, it is to be appreciated that while a lift-assist assembly was illustrated as providing sufficient upward force to bias and drive the locking member to the unlocked position and which force then must be then overcome by the application of downward force to lock the drawer, that alternative force balancing mechanism could also be employed. For example, the lift-assist assembly or assemblies may provide an upward lift assist function that is just short of the upward force to move the locking member to the unlocked position but that the driving member could be arranged to provide a small additional force to lift the locking member. In this design, when the driving member is moved to the locked position, the locking member would drop without the additional upward force provided on the projecting tab of the locking member by the driving member.

Still further, it should be appreciated that the upward unlocked position and the downward locked position could potentially be reversed if the latch mechanism was differently designed. Put differently, while the down position of the locking member/plate is the locked position as illustrated, if the rotation of the latch was reversed (such that the end of the latch rotates downwardly rather than upwardly as depicted when opened), then it may be possible for locking member to be pushed up to be in locking position. Thus, it will be appreciated that there are various configurations possible on this design including variations including different orientations as well as different variations relating to the default position of the locking member (i.e., the locking member could biased towards the locked or unlocked position depending on the design).

It should be appreciated that while detail of one of the locking mechanisms is illustrated in detail, that a cabinet could have multiple drawers in it, and such locking mechanisms could be independent attached to some or all of the drawers individually, or a single locking mechanism could secure a set of drawers using a locking member 122 with multiple protruding tabs as illustrated, for example.

In any event, such a locking mechanism or mechanisms can be used to selectively prevent access to one or more of the drawers with only minor modifications to the existing latch structure for the drawer pull and release. Still yet, it does not require the addition of a completely separate latching or securement system apart from the drawer pull and release mechanism that would function apart from the drawer pull and release mechanism. Effectively, the disclosed system allows a dual use for the existing latch element which is believed novel and not previously contemplated.

Still further, at a high level, it should be appreciated that the novel construction of the end cap, biasing member and latch and that the novel construction locking mechanism may be used independent of each other or in combination with each other. While a single embodiment has been illustrated that shows both concepts, it certainly is the case that the locking mechanism can be used separately from the improved end cap construction and assembly and vice-versa.

The invention has been described according to one or more preferred embodiments, and it should be appreciated that many equivalents, alternatives, variations, and modifications, aside from those expressly stated, are possible and within the scope of the invention.

What is claimed is:

1. A latching mechanism for latching closed a moveable member of a cabinet, the latching mechanism comprising:

a support having a back plate mounted to the moveable member, the back plate having an opening extending therethrough;

an end cap attached to a lateral end of the support and having a mating stem that extends at least partially into the support; and a latch having a leading end that extends through the opening in the back plate and a trailing end having a mating bore that is sized to receive the mating stem of the end cap, and wherein the mating bore defines a pivotal axis, wherein the latch is configured to pivot along the pivotal axis between an open position in which the moveable member is free from the cabinet and a closed position in which the latch prevents the moveable member from moving away from the cabinet.

2. The latching mechanism of claim 1, further comprising a pivoting member engaged to the trailing end of the latch for pivotal motion with respect to the moveable member, wherein pivoting from the pivoting member operates the latch to move the latch between the open position and the closed position.

3. The latching mechanism of claim 2, wherein the latch pivots independent of the pivoting member.

4. The latching mechanism of claim 1, wherein the mating bore is a through hole that extends through the width of the trailing end of the latch.

5. The latching mechanism of claim 1, wherein a spring biases the latch in a closed position.

6. The latching mechanism of claim 5, wherein the spring is a torsion spring that biases the latch in a closed position.

7. The latching mechanism of claim 6, wherein the trailing end of the latch includes a spring pocket configured to receive a terminal leg on one end of the torsion spring.

8. The latching mechanism of claim 6, wherein the trailing end of the latch includes a spring pocket that defines a recessed channel in the front face of the latch that extends between a first lateral side wall and a second lateral side wall.

9. The latching mechanism of claim 6, wherein the end cap includes a spring pocket configured to receive a terminal leg of the torsion spring.

10. The latching mechanism of claim 9, wherein the spring pocket defines a recessed channel on an inner wall of the end cap.

11. The latching mechanism of claim 9, wherein the spring pocket includes a shelf member that extends from an inner wall of the end cap.

12. A locking mechanism for locking a cabinet, the locking mechanism comprising:

a moveable member having a slideable connection to an interior surface within a mounting frame;

a support providing a pivotal connection and having a back plate mounted to the moveable member, the back plate having an opening extending therethrough;

a pivoting member attached to the pivotal connection for pivotal motion with respect to the pivoting member;

a latch having a leading end that extends through the opening in the back plate and a trailing end attached to the pivotal connection, the leading end of the latch having a catch surface and a locking stop surface, wherein the latch is operated by the pivoting member to pivot along a pivotal axis between an open position in which the moveable member is moveable within the cabinet and a closed position in which in which the catch surface engages the mounting frame to inhibit motion of the movable member; and a locking member attached to the mounting frame and being translatable between a locked position in which the locking member engages the locking stop surface of the latch to inhibit movement of the latch from the closed position to the open position and an unlocked position in which the latch is free to pivot along the pivotal axis from the closed position to the open position.

13. The locking mechanism of claim 12, wherein the locking member is panel sheet attached to an external surface of the mounting frame.

14. The locking mechanism of claim 13, wherein the panel sheet has one or more locking tabs projecting from a facial surface of the panel sheet, wherein at least one of the one or more locking tabs engage the locking stop surface of the latch when the locking member is in the locked position.

15. The locking mechanism of claim 12, wherein the locking member includes a latch pocket sized to receive the leading end.

16. The locking mechanism of claim 15, wherein the latch pocket is sized such that the leading end of the latch can pivot between the open position and the closed position when the locking mechanism is in the unlocked position.

17. The locking mechanism of claim 12, further comprising a lock and key assembly comprising:

a driving member attached to the locking member, wherein the driving member is configured to translate the locking member between the locked position and the unlocked position.

18. The locking mechanism of claim 17, wherein the driving member is a lever arm attached to the lock and key assembly.

19. The locking mechanism of claim 18, wherein the lock and key assembly includes a keyhole configured to receive a key that operates the lever arm to translate the locking member between the locked position and the unlocked position.

20. The locking mechanism of claim 14, wherein the movable member is one of a plurality of movable members of a cabinet each having a corresponding support associated therewith, a corresponding pivoting member associated therewith, and a corresponding latch associated therewith, and wherein the locking member is translatable between the locked position in which the locking member simultaneously engages all of the corresponding locking stop surfaces of the corresponding latches to inhibit movement of the corresponding latches from the closed position to the open position and an unlocked position in which the corresponding latches are free to pivot along their respective pivotal axes from the closed position to the open position.

* * * * *